US010789903B2

(12) United States Patent
Huang

(10) Patent No.: US 10,789,903 B2
(45) Date of Patent: Sep. 29, 2020

(54) DRIVING METHOD, DRIVING DEVICE, AND DISPLAY DEVICE

(71) Applicant: HKC Corporation Limited, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/158,694

(22) Filed: Oct. 12, 2018

(65) Prior Publication Data

US 2019/0189070 A1 Jun. 20, 2019

Related U.S. Application Data

(63) Continuation of application No. PCT/CN2018/097932, filed on Aug. 1, 2018.

(30) Foreign Application Priority Data

Dec. 18, 2017 (CN) ..... 2017 1 1369024

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01); *G09G 2300/0452* (2013.01)

(58) Field of Classification Search
CPC ..... G09G 2310/0235; G09G 3/3614; G09G 2300/0452; G09G 2300/0426
See application file for complete search history.

(56) References Cited

U.S. PATENT DOCUMENTS

2012/0313920 A1* 12/2012 Shimoshikiryoh .. G09G 3/3648 345/211
2013/0321483 A1* 12/2013 You ..... G09G 5/10 345/690
2017/0116934 A1* 4/2017 Tien ..... G09G 3/364
2018/0226045 A1* 8/2018 Sohn ..... G02F 1/13306

* cited by examiner

*Primary Examiner* — Yuzhen Shen
(74) *Attorney, Agent, or Firm* — WPAT, PC

(57) ABSTRACT

A driving method, a driving device and a display device are provided. The driving method includes the following steps: defining a plurality of pixel groups, each pixel group including two columns of adjacent pixel units, each pixel unit including a number of sub-pixels; in the same column of pixel units, applying opposite polarities of the driving voltage to two adjacent columns of sub-pixels; applying opposite polarities of the driving voltage to the corresponding sub-pixels of two adjacent pixel groups; applying driving voltage of different voltage level to the sub-pixels of the two adjacent pixel groups.

5 Claims, 8 Drawing Sheets

20 n n+1

| | | | | | | | | | | | |
|---|---|---|---|---|---|---|---|---|---|---|---|
| R1 H+ (i, j) | G1 H− (i, j) | B1 H+ (i, j) | R2 L+ (i, j+1) | G2 L− (i, j+1) | B2 L+ (i, j+1) | R1 H− (i, j+2) | G1 H+ (i, j+2) | B1 H− (i, j+2) | R2 L− (i, j+3) | G2 L+ (i, j+3) | B2 L− (i, j+3) |
| R2 L+ (i+1, j) | G2 L− (i+1, j) | B2 L+ (i+1, j) | R1 H+ (i+1, j+1) | G1 H− (i+1, j+1) | B1 H+ (i+1, j+1) | R2 L− (i+1, j+2) | G2 L+ (i+1, j+2) | B2 L− (i+1, j+2) | R1 H− (i+1, j+3) | G1 H+ (i+1, j+3) | B1 H− (i+1, j+3) |
| R1 H+ (i+2, j) | G1 H− (i+2, j) | B1 H+ (i+2, j) | R2 L+ (i+2, j+1) | G2 L− (i+2, j+1) | B2 L+ (i+2, j+1) | R1 H− (i+2, j+2) | G1 H+ (i+2, j+2) | B1 H− (i+2, j+2) | R2 L− (i+2, j+3) | G2 L+ (i+2, j+3) | B2 L− (i+2, j+3) |
| R2 L+ (i+3, j) | G2 L− (i+3, j) | B2 L+ (i+3, j) | R1 H+ (i+3, j+1) | G1 H− (i+3, j+1) | B1 H+ (i+3, j+1) | R2 L− (i+3, j+2) | G2 L+ (i+3, j+2) | B2 L− (i+3, j+2) | R1 H− (i+3, j+3) | G1 H+ (i+3, j+3) | B1 H− (i+3, j+3) |

20

| | | | |
|---|---|---|---|
| P1(i, j)<br>H | P2(i, j+1)<br>L | P1(i, j+2)<br>H | P2(i, j+3)<br>L |
| P2(i+1, j)<br>L | P1(i+1, j+1)<br>H | P2(i+1, j+2)<br>L | P1(i+1, j+3)<br>H |
| P1(i+2, j)<br>H | P2(i+2, j+1)<br>L | P1(i+2, j+2)<br>H | P2(i+2, j+3)<br>L |
| P2(i+3, j)<br>L | P1(i+3, j+1)<br>H | P2(i+3, j+2)<br>L | P1(i+3, j+3)<br>H |

20

| n | | | | | | n+1 | | | | | |
|---|---|---|---|---|---|---|---|---|---|---|---|
| R1<br>H+<br>(i, j) | G1<br>H−<br>(i, j) | B1<br>H+<br>(i, j) | R2<br>L+<br>(i, j+1) | G2<br>L−<br>(i, j+1) | B2<br>L+<br>(i, j+1) | R1<br>H−<br>(i, j+2) | G1<br>H+<br>(i, j+2) | B1<br>H−<br>(i, j+2) | R2<br>L−<br>(i, j+3) | G2<br>L+<br>(i, j+3) | B2<br>L−<br>(i, j+3) |
| R2<br>L+<br>(i+1, j) | G2<br>L−<br>(i+1, j) | B2<br>L+<br>(i+1, j) | R1<br>H+<br>(i+1, j+1) | G1<br>H−<br>(i+1, j+1) | B1<br>H+<br>(i+1, j+1) | R2<br>L−<br>(i+1, j+2) | G2<br>L+<br>(i+1, j+2) | B2<br>L−<br>(i+1, j+2) | R1<br>H−<br>(i+1, j+3) | G1<br>H+<br>(i+1, j+3) | B1<br>H−<br>(i+1, j+3) |
| R1<br>H+<br>(i+2, j) | G1<br>H−<br>(i+2, j) | B1<br>H+<br>(i+2, j) | R2<br>L+<br>(i+2, j+1) | G2<br>L−<br>(i+2, j+1) | B2<br>L+<br>(i+2, j+1) | R1<br>H−<br>(i+2, j+2) | G1<br>H+<br>(i+2, j+2) | B1<br>H−<br>(i+2, j+2) | R2<br>L−<br>(i+2, j+3) | G2<br>L+<br>(i+2, j+3) | B2<br>L−<br>(i+2, j+3) |
| R2<br>L+<br>(i+3, j) | G2<br>L−<br>(i+3, j) | B2<br>L+<br>(i+3, j) | R1<br>H+<br>(i+3, j+1) | G1<br>H−<br>(i+3, j+1) | B1<br>H+<br>(i+3, j+1) | R2<br>L−<br>(i+3, j+2) | G2<br>L+<br>(i+3, j+2) | B2<br>L−<br>(i+3, j+2) | R1<br>H−<br>(i+3, j+3) | G1<br>H+<br>(i+3, j+3) | B1<br>H−<br>(i+3, j+3) |

FIG. 3

20

| n | | | | | | n+1 | | | | | |
|---|---|---|---|---|---|---|---|---|---|---|---|
| R1<br>H−<br>(i, j) | G1<br>H+<br>(i, j) | B1<br>H−<br>(i, j) | R2<br>L−<br>(i, j+1) | G2<br>L+<br>(i, j+1) | B2<br>L−<br>(i, j+1) | R1<br>H+<br>(i, j+2) | G1<br>H−<br>(i, j+2) | B1<br>H+<br>(i, j+2) | R2<br>L+<br>(i, j+3) | G2<br>L−<br>(i, j+3) | B2<br>L+<br>(i, j+3) |
| R2<br>L−<br>(i+1, j) | G2<br>L+<br>(i+1, j) | B2<br>L−<br>(i+1, j) | R1<br>H−<br>(i+1, j+1) | G1<br>H+<br>(i+1, j+1) | B1<br>H−<br>(i+1, j+1) | R2<br>L+<br>(i+1, j+2) | G2<br>L−<br>(i+1, j+2) | B2<br>L+<br>(i+1, j+2) | R1<br>H+<br>(i+1, j+3) | G1<br>H−<br>(i+1, j+3) | B1<br>H+<br>(i+1, j+3) |
| R1<br>H−<br>(i+2, j) | G1<br>H+<br>(i+2, j) | B1<br>H−<br>(i+2, j) | R2<br>L−<br>(i+2, j+1) | G2<br>L+<br>(i+2, j+1) | B2<br>L−<br>(i+2, j+1) | R1<br>H+<br>(i+2, j+2) | G1<br>H−<br>(i+2, j+2) | B1<br>H+<br>(i+2, j+2) | R2<br>L+<br>(i+2, j+3) | G2<br>L−<br>(i+2, j+3) | B2<br>L+<br>(i+2, j+3) |
| R2<br>L−<br>(i+3, j) | G2<br>L+<br>(i+3, j) | B2<br>L−<br>(i+3, j) | R1<br>H−<br>(i+3, j+1) | G1<br>H+<br>(i+3, j+1) | B1<br>H−<br>(i+3, j+1) | R2<br>L+<br>(i+3, j+2) | G2<br>L−<br>(i+3, j+2) | B2<br>L+<br>(i+3, j+2) | R1<br>H+<br>(i+3, j+3) | G1<br>H−<br>(i+3, j+3) | B1<br>H+<br>(i+3, j+3) |

FIG. 4

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L | B2 L+ | R1 H− | G1 H+ | B1 H− | R2 L− | G2 L+ | B2 L− |
| R2 L+ | G2 L− | B2 L+ | R1 H+ | G1 H− | B1 H+ | R2 L− | G2 L+ | B2 L− | R1 H− | G1 H+ | B1 H− |

FIG. 5a

| | | | | | | | | | | | |
|---|---|---|---|---|---|---|---|---|---|---|---|
| R1 H− | G1 H+ | B1 H− | R2 L− | G2 L+ | B2 L− | R1 H+ | G1 H− | B1 H+ | R2 L+ | G2 L− | B2 L+ |
| R2 L− | G2 L+ | B2 L− | R1 H− | G2 H+ | B1 H− | R2 L+ | G2 L− | B2 L+ | R1 H+ | G1 H− | B1 H+ |
| R1 H− | G1 H+ | B1 H− | R2 L− | G2 L | B2 L− | R1 H+ | G1 H− | B1 H+ | R2 L+ | G2 L− | B2 L+ |
| R2 L− | G2 L+ | B2 L− | R1 H− | G1 H+ | B1 H− | R2 L+ | G2 L− | B2 L+ | R1 H+ | G1 H− | B1 H+ |

FIG. 5b

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L | B2 L+ | R1 H− | G1 H+ | B1 H− | R2 L− | G2 L+ | B2 L− |
| R2 L+ | G2 L− | B2 L+ | R1 H+ | G1 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L | B2 L+ | R1 H− | G1 H+ | B1 H− | R2 L− | G2 L+ | B2 L− |
| R2 L+ | G2 L− | B2 L+ | R1 H+ | G1 H− | B1 H+ | R2 L− | G2 L+ | B2 L− | R1 H− | G1 H+ | B1 H− |
| R1 H+ | G1 H− | B1 H+ | R2 L+ | G2 L | B2 L+ | R1 H− | G1 H+ | B1 H− | R2 L− | G2 L+ | B2 L− |
| R2 L+ | G2 L− | B2 L+ | R1 H+ | G1 H− | B1 H+ | R2 L− | G2 L+ | B2 L− | R1 H− | G1 H+ | B1 H− |

FIG. 5c

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L | B2 L+ | R1 H− | G1 H+ | B1 H− | R2 L− | G2 L+ | B2 L− |
| R2 L+ | G2 L− | B2 L+ | R1 H+ | G1 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |

FIG. 5d

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L | B2 L+ | R1 H− | G1 H+ | B1 H− | R2 L− | G2 L+ | B2 L− |
| R2 L+ | G2 L− | B2 L+ | R1 H+ | G1 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |

FIG. 5e

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |

FIG. 5f

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |

FIG. 5g

| | | | | | | | | | | | |
|---|---|---|---|---|---|---|---|---|---|---|---|
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |
| R1 H+ | G1 H− | B1 H+ | R2 L+ | G2 L− | B2 L+ | R1 H− | G1 H+ | B1 H− | R2 L− | G2 L+ | B2 L− |
| R2 L+ | G2 L− | B2 L+ | R1 H+ | G2 H− | B1 H+ | R2 L− | G2 L+ | B2 L− | R1 H− | G1 H+ | B1 H− |

DRIVING METHOD, DRIVING DEVICE, AND DISPLAY DEVICE

FIELD OF THE DISCLOSURE

The disclosure relates to a display technical field, and more particularly to a driving method for a display panel, a driving device for a display panel, and a display device including the driving device.

BACKGROUND

In the case of a vertical alignment (VA) liquid crystal display device, the liquid crystal molecules maintain a certain deflection angle at the time of displaying the screen, the transmittance of light at different viewing angles is different. As such, the user watches the screen at different angles will feel the color of the screen is different from the color deviation phenomenon.

In order to improve the color deviation problem, it is common practice to divide the pixel electrodes of the RGB sub-pixels in each pixel unit into two independent pixel electrodes, and to apply different driving voltages to the two pixel electrodes. In this way, due to the increase of the number of pixel electrodes, it is necessary to redesign more metal traces or TFT (Thin Film Transistor) components to drive the display panel. The metal traces and TFT components are not transparent, this method will sacrifice the translucent opening area, affect the transparency of the panel, and increase the cost of backlighting.

In order to avoid the addition of metal traces or TFT components, another method is applying two different driving voltage signals to each of the two adjacent pixel units. Specifically, at the same time, each adjacent two sub-pixels are applied with different polarity driving voltages. In this way, the positive and negative polarity of the high voltage of the same column of sub-pixels does not match, that is, the number of sub-pixels of positive polarity high voltage in the same column does not coincide with the number of sub-pixels of negative polarity high voltage. In this way, the equivalent voltage of the common voltage Vcom is higher than that of the original Vcom, resulting in the reduction of the actual charge of the sub-pixel with positive polarity and the decrease of the luminance. On the contrary, the actual charge of the negative high voltage sub-pixel is increased and the brightness is increased. And thus the display color and picture quality are affected, resulting in abnormal quality output problem.

SUMMARY

Based on this, it is necessary to provide a driving method for a display panel, a driving device for a display panel, and a display device, which can protect the Vcom voltage from interference, ensure the correctness of the image signal, and improve the picture display quality In one embodiment, the present disclosure provides a driving method for a display panel. The driving method includes the following steps: defining a plurality of pixel groups, each pixel group including two columns of adjacent pixel units, each pixel unit including a number of sub-pixels; in the same column of pixel units, applying opposite polarities of the driving voltage to two adjacent columns of sub-pixels; applying opposite polarities of the driving voltage to the corresponding sub-pixels of two adjacent pixel groups; applying driving voltage of different voltage levels to the sub-pixels of the two adjacent pixel groups.

In one embodiment, the present disclosure provides a driving method for a display panel. The driving method includes the following steps: providing a plurality of pixel groups, the pixel groups comprising a first pixel group and an adjacent second pixel group, each of the pixel groups comprising a first pixel unit and an adjacent second pixel unit, each of the pixel units comprising a first sub-pixel and an adjacent second sub-pixel; applying a driving voltage of a first voltage level to the first pixel unit; applying a driving voltage of a second voltage level to the second pixel unit; Wherein the polarity of the driving voltage applied to the first sub-pixels of the first pixel group is the same, and is opposite to that applied to the first sub-pixels of the second pixel group; the polarity of the driving voltage applied to the second sub-pixels of the first pixel group is the same, and is opposite to that applied to the second sub-pixels of the second pixel group; in each of the pixel units, the polarity of the driving voltage applied to the first pixel is opposite to that of the second pixel; when the image is displayed for each frame, the polarity of the driving voltage applied to each sub-pixel is opposite to that of the last frame.

In one embodiment, the present disclosure provides a driving device for a display panel. The driving device includes a grouping module and a driving module. The driving module includes a first driving unit, a second driving unit, and a third driving unit. The grouping module is configured for setting a plurality of pixel groups, each of the pixel groups includes two columns of adjacent pixel units. The first driving unit is configured for applying opposite polarities of the driving voltage to two adjacent columns of sub-pixels are opposite, in the same column of pixel units. The second driving unit is configured for applying opposite polarities of the driving voltage to the corresponding sub-pixels of two adjacent pixel groups. The third driving unit is configured for applying driving voltage of different voltage level to the sub-pixels of the first pixel groups and the sub-pixels of the second pixel groups.

In one embodiment, the present disclosure provides a driving device for a display panel. The driving device includes a grouping module and a driving module. The grouping module is configured for defining a plurality of pixel groups, the pixel groups are defined as comprising a first pixel group and an adjacent second pixel group, each of the pixel groups comprises a first pixel unit and an adjacent second pixel unit, each of the pixel units comprises a first sub-pixel and an adjacent second sub-pixel. The driving module comprises a voltage level determining unit, a voltage polarity distributing unit, and a voltage polarity transferring unit. The voltage level determining unit is configured for determining the voltage level applied to each of the pixel units, the voltage polarity distributing unit is configured for determining the voltage polarity applied to each of the sub-pixels, the voltage polarity transferring unit is configured for transferring the voltage polarity applied to each of the sub-pixels when the next frame image is coming to be displayed.

In one embodiment, the present disclosure provides a display device. The display device includes a display panel and the driving device as the above described.

The driving method, driving device and display device of the present application may have the following advantages. In each row of pixel of the display panel, the number of the sub-pixels with the positive polarity high voltage level is equal to the sub-pixels with the negative polarity high voltage level. As such, it is capable of preventing the Vcom voltage from affection of the parasitic capacitance, the correctness of the image signal is ensured, and the occurrence of color cast or abnormal image is avoided.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures:

FIG. 3 is a schematic view of driving voltage applied to each sub-pixel of the pixel units of a display panel, according to an embodiment of the disclosure;

FIG. 4 is a schematic view of driving voltage applied to each sub-pixel of the pixel units of a display panel, according to another embodiment of the disclosure;

FIG. 5*a* is a schematic view of driving voltage applied to the pixel units when the display panel shows a specific screen, according to an embodiment of the disclosure;

FIG. 5*b* is a schematic view of driving voltage applied to the pixel units when the display panel shows a specific screen, according to an embodiment of the disclosure;

FIG. 5*c* is a schematic view of driving voltage applied to the pixel units when the display panel shows a specific screen, according to an embodiment of the disclosure;

FIG. 5*d* is a schematic view of driving voltage applied to the pixel units when the display panel shows a specific screen, according to an embodiment of the disclosure;

FIG. 5*e* is a schematic view of driving voltage applied to the pixel units when the display panel shows a specific screen, according to an embodiment of the disclosure;

FIG. 5*f* is a schematic view of driving voltage applied to the pixel units when the display panel shows a specific screen, according to an embodiment of the disclosure;

FIG. 5*g* is a schematic view of driving voltage applied to the pixel units when the display panel shows a specific screen, according to an embodiment of the disclosure;

DETAILED DESCRIPTION OF PREFERRED EMBODIMENTS

Figures 1, 2:
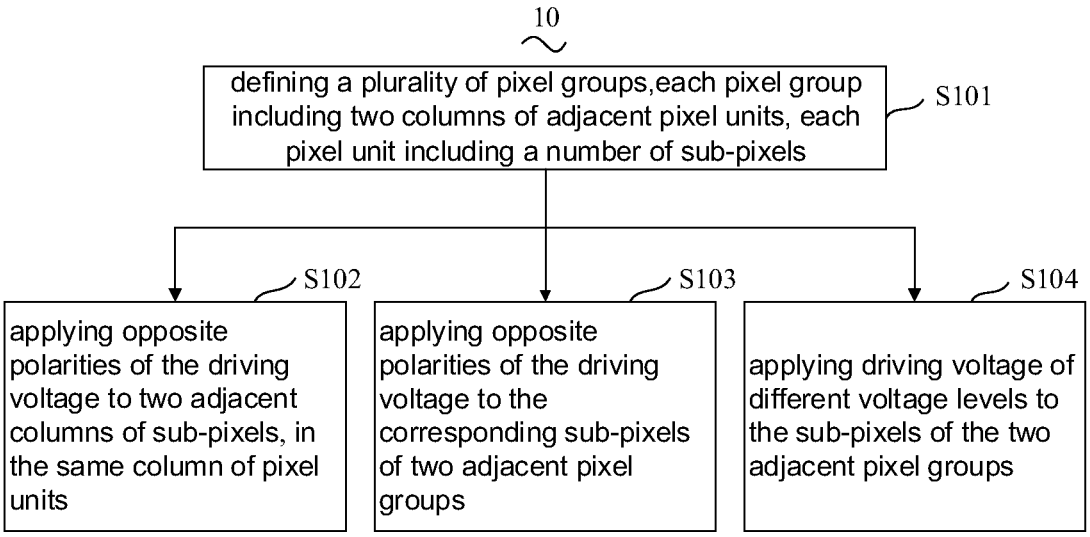
FIG. 1 is a flow chart of a driving method for a display panel, according to an embodiment of the disclosure.
FIG. 2 is a schematic view of driving voltage applied to a number of pixel units of a display panel, according to an embodiment of the disclosure.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

Referring to FIG. 1 to FIG. 4, FIG. 1 is a flow chart of a driving method 10 for a display panel 20 according to one embodiment of the present invention, and the driving method is applied to the display panel 20. As shown in FIG. 1, the driving method 10 comprises the following steps.

S101, a plurality of pixel groups are defined, and each pixel group includes two columns of adjacent pixel units.

For example, the display panel 20 has a number of first pixel units and a number of second pixel units, and the pixel units are defined to be a number of pixel groups. For instance, the first pixel units and the second pixel units are arranged adjacent to each other.

S102, applying opposite polarities of the driving voltage to two adjacent columns of sub-pixels, in the same column of pixel units.

S103, applying opposite polarities of the driving voltage to the corresponding sub-pixels of two adjacent pixel groups.

S104, applying driving voltage of different voltage level to the sub-pixels of the two adjacent pixel groups.

In practical application, steps S102, S103, and S104 may be performed at the same time. For example, the driving voltages are simultaneously applied to the respective sub-pixels in the display panel at the display time of the same frame, so that the driving voltage of each of the adjacent two sub-pixels in the same column pixel unit is opposite in polarity. Meanwhile, polarities of the driving voltage to the corresponding sub-pixels of two adjacent pixel groups are opposite, and the voltage level of the driving voltage applied to the sub-pixel in the first pixel unit and the sub-pixel in the second pixel unit is different.

For example, the different voltage levels include the high voltage level and the low voltage level. The number of sub-pixels that applied with the positive polarity driving voltage with the high voltage level in each row pixel is equal to the number of sub-pixels that applied with the negative polarity driving voltage with the high voltage level. So that the Vcom voltage is protected from the parasitic capacitance, the correctness of the image signal is ensured, and occurrence of color shift or image quality abnormality is avoided.

The "row" and "column" of the embodiments of the present application indicate two perpendicular directions, for example, "row" means a horizontal direction, and "column" means a vertical direction. For another example, "row" for a vertical direction, "column" for a lateral direction. That is, the "rows" in the embodiments of the present application may be "columns" as understood by one of ordinary skill in the art, and "columns" in the embodiments of the present application may be understood as "rows".

As shown in FIG. 2, the display panel 20 has a plurality of pixel units distributed in a matrix, the plurality of pixel units includes a plurality of first pixel units P1 and a plurality of second pixel units P2. The first and second pixel units are arranged adjacent to each other, and the first pixel unit and the second pixel unit are alternately arranged. Specifically, each of the pixel units includes a plurality of sub-pixels, for example, each pixel unit includes a plurality of sub-pixels having different colors. Each pixel unit includes a red sub-pixel R, a green sub-pixel G, and a blue sub-pixel B these three sub-pixels. It is noted that, (i, j) represents the ith row and the jth column, (i, j+1) represents the ith row and the j+1th column, (i+1, j) represents the i+1th row and the jth column, and so on.

For example, as shown in FIG. 3, the matrix includes four columns of pixel units and four rows, and is divided into two pixel groups, i.e., the nth group and the n+1th group. Each pixel group includes two adjacent columns of pixel units. R1, G1, and B1 denote red sub-pixels, green sub-pixels, and blue sub-pixels in the first pixel unit P1, respectively. R2, G2, and B2 denote red sub-pixels, green sub-pixels, and blue sub-pixels in the second pixel unit P2, respectively. H denotes a first voltage level, L denotes a second voltage level, + denotes a positive polarity, and – denotes a negative polarity.

According to the above-described driving method, in the same column of pixel units, polarities of the driving voltage applied to two adjacent columns of sub-pixels are opposite. For example, the R sub-pixels of the jth column, the G sub-pixels of the jth column, and the B sub-pixels belong to the jth column all belong to the jth column of pixel unit. And, the G sub-pixels of the jth column is adjacent to and sandwiched between the R sub-pixels of the jth column and the B sub-pixels of the jth column. A driving voltage having a negative polarity is applied to the G sub-pixels of the jth column, and a driving voltage having a positive polarity is applied to the R sub-pixels of the jth column and the B sub-pixels of the jth column. Or, a driving voltage having a positive polarity is applied to the G sub-pixels of the jth column, and a driving voltage having a negative polarity is applied to the R sub-pixels of the jth column and the B sub-pixels of the jth column.

In the present embodiment, the positive polarity means that the magnitude of the driving voltage is larger than the preset voltage Vcom of the display panel. That is, the voltage difference between the driving voltage and the Vcom voltage is greater than zero. The negative polarity means that the magnitude of the driving voltage is smaller than the Vcom voltage, and the voltage difference between the drive voltage and the Vcom voltage is less than zero.

According to the above-described driving method, polarities of the driving voltage applied to the corresponding sub-pixels of two adjacent pixel groups are opposite. The corresponding sub-pixels refer to the sub-pixels having corresponding arrangement order or having corresponding arrangement position. For example, each of the pixel units includes a first sub-pixel, a second sub-pixel, and a third sub-pixel arranged in order, the first sub-pixels of the two adjacent pixel groups are the corresponding sub-pixels, the second sub-pixels of the two adjacent pixel groups are the corresponding sub-pixels, the third sub-pixels of the two adjacent pixel groups are the corresponding sub-pixels. At this time, driving voltage of opposite polarities are applied to the first sub-pixels of the pixel groups, respectively. Driving voltage of opposite polarities are applied to the second sub-pixels of the pixel groups, respectively. Driving voltage of opposite polarities are applied to the third sub-pixels of the pixel groups, respectively. For another example, the nth group and the n+1th group are two adjacent pixel groups. Driving voltage having a positive polarity is applied to the R sub-pixels of the nth group, meanwhile driving voltage having a negative polarity is applied to the R sub-pixels of the n+1th group. Driving voltage having a negative polarity is applied to the G sub-pixels of the nth group, meanwhile driving voltage having a positive polarity is applied to the G sub-pixels of the n+1th group. Driving voltage having a positive polarity is applied to the B sub-pixels of the nth group, meanwhile driving voltage having a negative polarity is applied to the B sub-pixels of the n+1th group. Or, driving voltage having a negative polarity is applied to the R sub-pixels of the nth group, meanwhile driving voltage having a positive polarity is applied to the R sub-pixels of the n+1th group. Driving voltage having a positive polarity is applied to the G sub-pixels of the nth group, meanwhile driving voltage having a negative polarity is applied to the G sub-pixels of the n+1th group. Driving voltage having a negative polarity is applied to the B sub-pixels of the nth group, meanwhile driving voltage having a positive polarity is applied to the B sub-pixels of the n+1th group. As such, polarities of the driving voltage applied to the corresponding sub-pixels of two adjacent pixel groups are opposite.

According to the above described method, driving voltage of a different voltage level is applied to the sub-pixels in the first pixel unit and the sub-pixels in the second pixel unit, respectively. For example, the levels of driving voltage corresponding to the first pixel unit and the second pixel unit are predetermined. In advance, a first driving voltage level is predetermined corresponding to the first pixel unit, and a second driving voltage level is predetermined corresponding to the second pixel unit.

As an embodiment, a driving voltage of a preset first voltage level is applied to the sub-pixels in the first pixel unit, and a driving voltage of a preset second voltage level is applied to the sub-pixels in the second pixel unit. One of the first driving voltage level and the second driving voltage level is a high voltage level and the other is a low voltage level. For example, the first drive voltage level is higher than the second drive voltage level, or the first drive voltage level is lower than the second drive voltage level.

With the above-described method, in each row of pixel of the display panel, the number of the sub-pixels with the positive polarity high voltage level (H+) is equal to the sub-pixels with the negative polarity high voltage level (H−). For example, in each row of FIG. 3, the sub-pixels representing the positive polarity high voltage level (H+) and the sub-pixels representing the negative polarity high voltage level (H−) each are three. As such, it is capable of protecting the Vcom voltage from the parasitic capacitance, the correctness of the image signal is ensured, and the occurrence of color cast or abnormal image is avoided.

In one embodiment, the driving method further includes steps of applying a driving voltage of the same polarity to each of the pixel units in the same pixel group, and applying driving voltage of opposite polarities to two adjacent sub-pixels in the same pixel unit. For example, in the same pixel group, the corresponding sub-pixels of each pixel unit are applied with the driving voltage of the same polarity. In the same pixel unit, the first sub-pixel and the third sub-pixel are applied with the driving voltage of the same polarity, and the second sub-pixel and the first sub-pixel are applied with the driving voltage of opposite polarities. As shown in FIG. 3, a driving voltage of positive polarity is applied to the R sub-pixels of each pixel unit in the nth group, a negative polarity driving voltage is applied to the G sub-pixels of each pixel unit in the nth group, and a positive polarity driving voltage is applied to the B sub-pixels in the nth group. As such, not only the polarity of the driving voltage of each pixel unit in the same pixel group is coincident, but also in any one of the pixel units, the R sub-pixel has an opposite polarity to that of the G sub-pixel, the G sub-pixel has an opposite polarity to that of the B sub-pixel. That is, the driving voltage of each of the two adjacent sub-pixels in the same pixel unit is opposite in polarity. In this way, in the case of the same number of sub-pixels with positive and negative polarities in each row, the driving voltage of the same column of sub-pixels can be made to have the same polarity. The difference between the voltage signals output from the same data line is maintained within a small range, and the data-driven chip heating or voltage signal distortion can be avoided, thereby further improving the display quality of each sub-pixel.

In one embodiment, the display panel is a liquid crystal display panel. In view of the fact that the DC electric field driving the liquid crystal pixel tends to cause a chemical reaction of the liquid crystal material and accelerates the aging of the electrode, thereby shortening the life of the display panel, so that in order to protect the liquid crystal material and the electrode, and the life of the panel, the AC electric field is adopted to drive the sub-pixels in the display panel. Specifically, a driving voltage of different polarities is applied to the same sub-pixel, in display time of each two adjacent image frames, to achieve the effect of AC drive.

For example, the driving method further includes a step of applying driving voltage of opposite polarities alternately to the same sub-pixel in each of the two adjacent image frames. Or, the polarity of the driving voltage applied to each sub-pixel is opposite to that of the last frame. For example, in the mth frame, a driving voltage as shown in FIG. 3 is applied to some of the sub-pixels in the display panel. In the m+1th frame, those sub-pixels are applied with the driving voltage as shown in FIG. 4. It can be seen that the polarity of the driving voltage of the same sub-pixel is changed within each two adjacent frames, and the driving voltage level remains unchanged.

As an embodiment, when driving the display panel, the driving voltage polarity is determined for each sub-pixel according to the pixel group to which it belongs and its position in the pixel group, and the driving voltage level is determined according to the pixel unit. Then by a predetermined data processing circuit, a driving voltage of each sub-pixel is obtained, based on image data of each sub-pixel, a corresponding driving voltage polarity and level. Finally the driving voltage is applied to the respective sub-pixels through data lines.

Figures 5H, 6:
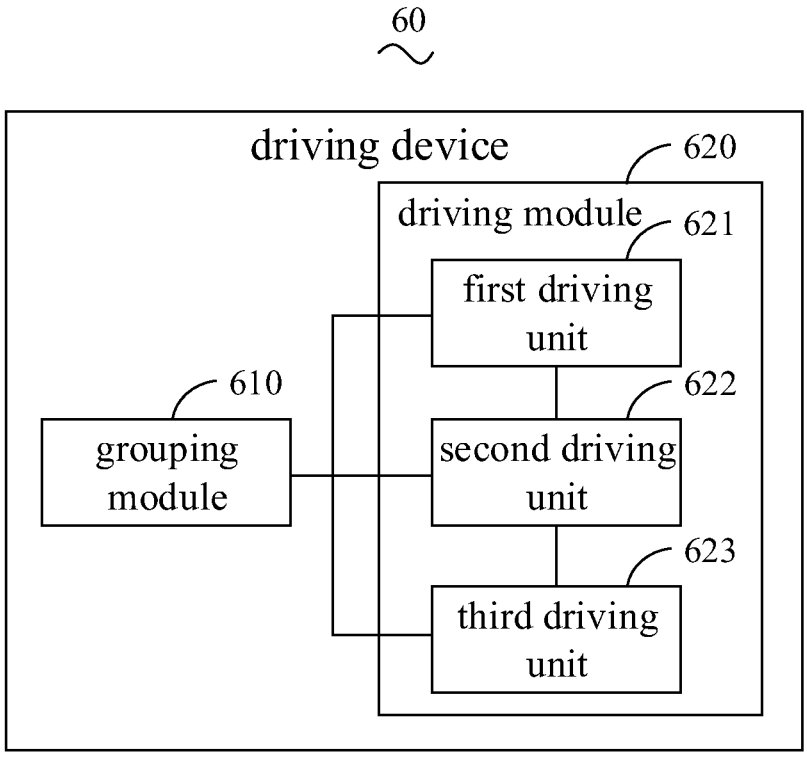
FIG. 5*h* is a schematic view of driving voltage applied to the pixel units when the display panel shows a specific screen, according to an embodiment of the disclosure.
FIG. 6 is a schematic view of a driving device for a display panel, according to an embodiment of the disclosure.

The driving display method of the display panel is used to drive the display panel to display the specific test screens shown in FIGS. 5*a*, 5*b*, 5*c*, 5*d*, 5*e*, 5*f*, 5*g* and 5*h*. Sub-pixels filled with a black slash indicate that the data signal corresponding to the sub-pixels are dark state signals. Experiments show that the flicker picture of FIGS. 5*a* and 5*b* to the screen of FIG. 5*h* without of color deviation. The picture of FIG. 5*c* avoids crosstalk in the horizontal direction, and there is no color deviation problem in FIG. 5*d*. FIG. 5*d* shows the image that is alternately bright/dark displayed every other pixel unit. FIG. 5*e* shows the image that is alternately bright/dark displayed every two pixel units. FIG. 5*f* shows the image that is alternately bright/dark displayed every other sub-pixel. FIG. 5*g* shows the image that is alternately bright/dark displayed every other column of sub-pixel. FIG. 5*h* shows the image that is alternately bright/dark displayed every other column of pixel unit. Thus, it is noted that the driving method of the display panel of the embodiment of the present application has a good color deviation improving effect.

In another embodiment of the present application, a driving method includes the following steps is provided.

Step 1, a plurality of pixel groups are provided. The pixel groups includes a first pixel group and an adjacent second pixel group. For example, the display panel 20 defines an nth group and an n+1th group. Each of the pixel groups comprises at least two columns of pixel units. For example, each of the pixel groups includes a plurality of first pixel units P1 and a plurality of second pixel units P2, the first pixel units P1 and the second pixel units P2 are arranged in a matrix and are alternately arranged. In other words, there are second pixel units P2 at left, right, upper, and lower sides of each first pixel unit P1. That means each first pixel unit P1 is surrounded by the second pixel units P2, and each second pixel unit P2 is surrounded by the first pixel units P1. Each of the pixel units includes a first pixel unit, a second pixel unit, and a third pixel unit arranged along a row. The second sub-pixel is adjacent to and sandwiched between the first sub-pixel and the third sub-pixel. The first, the second, and the third sub-pixels are red sub-pixel R, green sub-pixel G, and blue sub-pixel B, respectively.

As shown in FIG. 2 and FIG. 3, with 4 rows and 4 columns of pixel units, for example, the nth group includes two columns of pixel units, the n+1th group also includes two columns of pixel units. R1 represents the red sub-pixel of the first pixel unit P1, G1 represents the green sub-pixel of the first pixel unit P1, B1 represents the blue sub-pixel of the first pixel unit P2, R2 represents the red sub-pixel of the second pixel unit P2, G2 represents the green sub-pixel of the second pixel unit P2, B2 represents the blue sub-pixel of the second pixel unit P2. (i, j) represents the ith row and the jth column, (i, j+1) represents the ith row and j+1th column, (i+1, j) represents the i+1th row and jth column, and so on.

Step 2, a driving voltage of a first voltage level is applied to the first pixel unit, and a driving voltage of a second voltage level is applied to the second pixel unit.

Step 3, the polarity of the driving voltage applied to each sub-pixel is determined. The polarity of the driving voltage applied to the first sub-pixels of the first pixel group is the same, and is opposite to that applied to the first sub-pixels of the second pixel group. The polarity of the driving voltage applied to the second sub-pixels of the first pixel group is the same, and is opposite to that applied to the second sub-pixels of the second pixel group. In each of the pixel units, the polarity of the driving voltage applied to the first pixel is opposite to that of the second pixel.

Step 4, the polarity of the driving voltage applied to each sub-pixel is changed when the image is coming to be displayed for the next frame. Specifically, the polarity of the driving voltage applied to each sub-pixel is opposite to that of the last frame. The polarity of the driving voltage applied to each sub-pixel is opposite to that of the next frame.

The order of the above steps is not limited and can be changed in succession or at the same time. By a predetermined data processing circuit, driving voltage of each sub-pixel is obtained, and applied to the respective sub-pixels through data lines.

The present embodiment also provides a driving device 60 for displaying a panel. The display panel has a number of pixel units arranged in a matrix. The pixel units includes a number of first pixel units and a number of second pixel units arranged adjacent to the first pixel units. Each of the pixel units includes a plurality of sub-pixels.

Referring to FIG. 6, the drive device 60 includes a grouping module 610 and a driving module 620. The driving module 620 includes a first driving unit 621, a second driving unit 622, and a third driving unit 623. The grouping module 610 is configured for setting a plurality of pixel groups, each of the pixel groups includes two columns of adjacent pixel units. The first driving unit 621 is configured for applying opposite polarities of the driving voltage to two adjacent columns of sub-pixels are opposite, in the same column of pixel units. The second driving unit 622 is configured for applying opposite polarities of the driving voltage to the corresponding sub-pixels of two adjacent pixel groups. The third driving unit 623 is configured for applying driving voltage of different voltage level to the sub-pixels of the first pixel groups and the sub-pixels of the second pixel groups. For example, the pixel unit includes a first sub-pixel, a second sub-pixel, and a third sub-pixel sequentially arranged. The second driving unit is further configured for applying opposite polarities of the driving voltage to the first sub-pixels of two adjacent pixel groups, applying opposite polarities of the driving voltage to the second sub-pixels of two adjacent pixel groups, opposite polarities of the driving voltage to the third sub-pixels of two adjacent pixel groups. As such, in each row, the number of the sub-pixels with the positive polarity high voltage level (H+) is equal to the sub-pixels with the negative polarity high voltage level (H−). It is capable of protecting the Vcom voltage from the parasitic capacitance, the correctness of the image signal is ensured, and the occurrence of color cast or abnormal image is avoided.

In one embodiment, the third drive unit 623 is further configured for applying a drive voltage of a preset first voltage level to sub-pixels in the first pixel unit, and applying a drive voltage of a preset second voltage level to sub-pixels in the second pixel unit. In this way, it is possible to ensure that the driving voltage level of each of the two adjacent pixel units is different, and the driving voltage of the sub-pixels in each two adjacent sub-pixel groups is opposite in polarity.

In one embodiment, the drive module 620 further includes a fourth driving unit and a fifth driving unit. The fourth driving unit is configured for applying a driving voltage of the same polarity to each of the pixel units in the same pixels group. The fifth driving unit is configured for applying driving voltage of opposite polarities to each adjacent two sub-pixels in the same pixel unit. For example, the fifth driving unit is further configured for applying driving voltage having the same polarity to the first sub-pixel and the third sub-pixel in the same pixel unit, and applying driving voltage having the opposite polarities to the first sub-pixel and the second sub-pixel in the same pixel unit. In this way, in the case of the same number of sub-pixels with positive and negative polarities in each row, the driving voltage of the same column of sub-pixels can be made to have the same polarity. The difference between the voltage signals output from the same data line is maintained within a small range, and the data-driven chip heating or voltage signal distortion can be avoided, thereby further improving the display quality of each sub-pixel.

In one embodiment, the driving module further comprises a sixth driving unit. The sixth driving unit is configured for alternately applying a driving voltage of opposite polarities to the same sub-pixel within each two adjacent frames. In this way, the sub-pixels can be AC driven, so as to protect the liquid crystal materials and electrodes, and extend the life of the display panel.

In another embodiment of the present invention, a driving device for a display panel using a driving method according to any one of the above embodiments is provided. For example, a driving device for a display panel is realized by a driving method of a display panel according to any one of the above embodiments. A driving device for a display panel has functional modules corresponding to the driving method, according to any one of the above embodiments.

Figure 7:
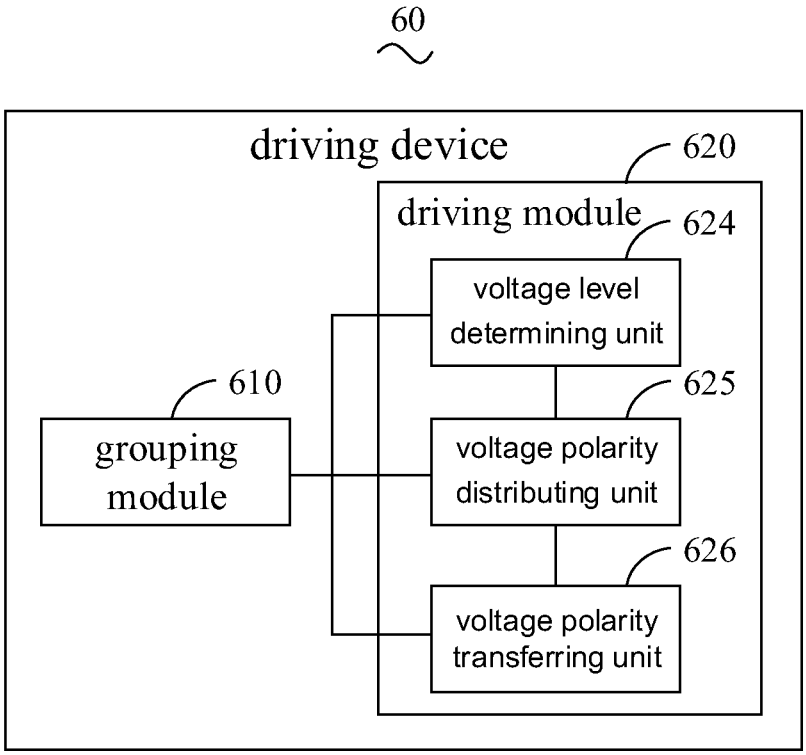
FIG. 7 is a schematic view of a driving device for a display panel, according to another embodiment of the disclosure.

In one embodiment, referring to FIG. 7, a driving device 60 for a display panel, includes a grouping module 610 and a driving module 620. The grouping module 610 is configured for defining a plurality of pixel groups. The pixel groups comprise a first pixel group and an adjacent second pixel group, each of the pixel groups comprises a first pixel unit and an adjacent second pixel unit, each of the pixel units comprises a first sub-pixel and an adjacent second sub-pixel. The driving module 620 comprises a voltage level determining unit 624, a voltage polarity distributing unit 625, and a voltage polarity transferring unit 626. The voltage level determining unit 624 is configured for determining the voltage level applied to each of the pixel units, the voltage polarity distributing unit 625 is configured for determining the voltage polarity applied to each of the sub-pixels, the voltage polarity transferring unit 626 is configured for transferring the voltage polarity applied to each of the sub-pixels when the next frame image is coming to be displayed.

The driving method and the driving device of the display panel of the present application can be applied to, for example, a liquid crystal display panel, an OLED (Organic Light-Emitting Diode) display panel, a QLED (Quantum Dot Light Emitting Diodes) Panel, surface display panel or flexible display panel. For example, in the case of a liquid crystal display panel, can be a TN (Twisted Nematic) liquid crystal display panel, an IPS (In-Plane Switching) liquid crystal display panel, a PLS (Plane to Line Switching)) Liquid crystal display panel, or MVA (Multi-domain Vertical Alignment) liquid crystal display panel. Among them, the above display panel can be driven by a logic board of a full HD display panel. The driving method and the driving device of the display panel can be realized by a logic board of a full HD display panel.

Figure 8:
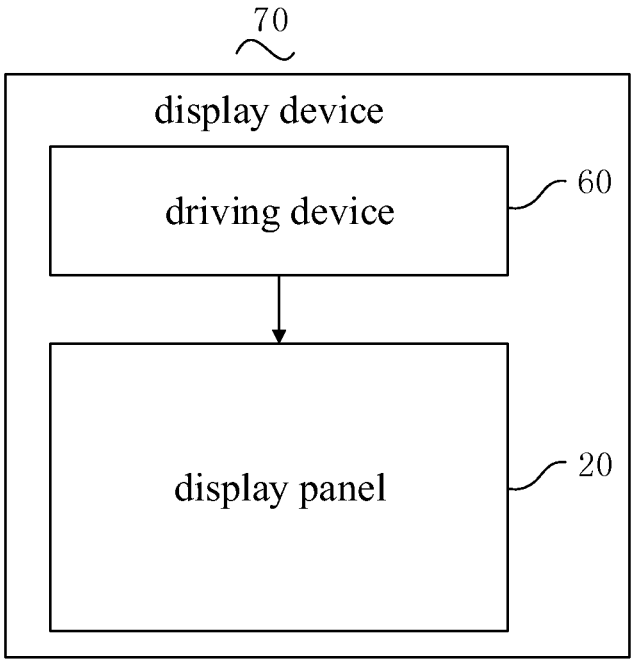
FIG. 8 is a structural schematic view of a display device according to an embodiment of the disclosure.

The present invention also provides a display device comprising a display panel 20 and a driving device 60 as shown in any one of the embodiments described above, as shown in FIG. 8.

For example, the display device is a liquid crystal display device, an OLED display device or a QLED display device, a surface display device, a flexible display device, and the like. As another example, a liquid crystal display device may be a TN liquid crystal display, an IPS liquid crystal display, a PLS liquid crystal display, or an MVA liquid crystal display.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A driving method for a display panel, wherein the display panel comprises a plurality of pixel units arranged in rows and columns, the plurality of pixel units comprise first pixel units and second pixel units, the first pixel units and the second pixel units are alternately arranged in each row as well as in each column; the driving method comprising:

providing a plurality of pixel groups, wherein the plurality of pixel groups comprise a first pixel group and an adjacent second pixel group, each of the first and second pixel groups comprise two adjacent columns of the plurality of pixel units and no less than four rows of the plurality of pixel units, the two adjacent columns of the plurality of pixel units comprise one of the first pixel units and one of the second pixel units adjacent to the first pixel unit in each row, each of the first and second pixel units consisted of a first sub-pixel, a second sub-pixel and a third sub-pixel with different colors, the first sub-pixel, the second sub-pixel, and the third sub-pixel are arranged adjacent in that order and along a row;

applying a driving voltage of a first voltage level to the first pixel unit;

applying a driving voltage of a second voltage level to the second pixel unit;

wherein the polarity of the driving voltage applied to the first sub-pixels of the first pixel group is the same, and is opposite to that applied to the first sub-pixels of the second pixel group;

the polarity of the driving voltage applied to the second sub-pixels of the first pixel group is the same, and is opposite to that applied to the second sub-pixels of the second pixel group;

the polarity of the driving voltage applied to the third sub-pixels of the first pixel group is the same, and is opposite to that applied to the third sub-pixels of the second pixel group;

in each of the plurality of pixel units, the polarity of the driving voltage applied to the first sub-pixel is opposite to that of the second sub-pixel;

in each of the plurality of pixel units, the polarity of the driving voltage applied to the third sub-pixel is the same to that of the first sub-pixel;

wherein in adjacent two frame display times, the driving voltage for same one sub-pixel is changed in polarity while the driving voltage for the same one sub-pixel is kept unchanged in driving voltage level, the same one sub-pixel is the first sub-pixel, the second sub-pixel or the third sub-pixel;

wherein in each of the adjacent two frame display times, the driving voltages applied to the first sub-pixels, the second sub-pixels or the third sub-pixels all in a same column have a same polarity.

2. The driving method for a display panel according to claim 1, wherein the driving voltage of the first voltage level is higher than that of the second voltage level.

3. The driving method for a display panel according to claim 1, wherein the driving voltage of the first voltage level is lower than that of the second voltage level.

4. The driving method for a display panel according to claim 1, wherein the first, the second, and the third sub-pixels are the red, the green, and the blue sub-pixels, respectively.

5. A display device, comprising a display panel and a driving device, wherein the display panel comprises a plurality of pixel units arranged in rows and columns, the plurality of pixel units comprise first pixel units and second pixel units, the first pixel units and the second pixel units are alternately arranged in each row as well as in each column; wherein the driving device is configured for:

defining a plurality of pixel groups, the plurality of pixel groups being defined as comprising a first pixel group and an adjacent second pixel group, each of the first and second pixel groups comprising two adjacent columns of the plurality of pixel units and no less than four rows of the plurality of pixel units, the two adjacent columns of the plurality of pixel units comprising one of the first pixel units and one of the second pixel units adjacent to the first pixel unit in each row, each of the first and second pixel units consisting of a first sub-pixel, a second sub-pixel and a third sub-pixel with different colors, wherein the first sub-pixel, the second sub-pixel, and the third sub-pixel are arranged adjacent in that order and along a row;

determining the voltage level applied to each of the plurality of pixel units, determining a voltage polarity applied to each of the first through third sub-pixels, transferring the voltage polarity applied to each of the first through third sub-pixels when the next frame image is coming to be displayed;

wherein the voltage polarity applied to the first sub-pixels of the first pixel group is the same, and is opposite to that applied to the first sub-pixels of the second pixel group;

the voltage polarity applied to the second sub-pixels of the first pixel group is the same, and is opposite to that applied to the second sub-pixels of the second pixel group;

the voltage polarity applied to the third sub-pixels of the first pixel group is the same, and is opposite to that applied to the third sub-pixels of the second pixel group;

in each of the plurality of pixel units, the voltage polarity applied to the first sub-pixel is opposite to that of the second sub-pixel;

in each of the plurality of pixel units, the voltage polarity applied to the third sub-pixel is the same to that of the first sub-pixel;

wherein in adjacent two frame display times, a driving voltage for same one sub-pixel is changed in voltage polarity while the driving voltage for the same one sub-pixel is kept unchanged in voltage level, the same one sub-pixel is the first sub-pixel, the second sub-pixel or the third sub-pixel;

wherein in each of the adjacent two frame display times, the driving voltages applied to the first sub-pixels, the second sub-pixels or the third sub-pixels all in a same column have a same polarity.

* * * * *